US012410972B2

(12) United States Patent
Caretta Crichlow et al.

(10) Patent No.: US 12,410,972 B2
(45) Date of Patent: Sep. 9, 2025

(54) REFRIGERATING CONTAINER

(71) Applicant: UNIVERSITA' DEGLI STUDI DI TRENTO, Trento (IT)

(72) Inventors: Matthias Caretta Crichlow, Povo (IT); Gabriele Fadini, Povo (IT); Yangzhe Kong, Povo (IT); Teyi Kung, Povo (IT); Fabio Massacci, Povo (IT); Francesco Minna, Povo (IT); Riccardo Sparagna, Povo (IT)

(73) Assignee: UNIVERSITA' DEGLI STUDI DI TRENTO, Trento (IT)

( * ) Notice: Subject to any disclaimer, the term of this patent is extended or adjusted under 35 U.S.C. 154(b) by 199 days.

(21) Appl. No.: 18/259,102

(22) PCT Filed: Dec. 21, 2021

(86) PCT No.: PCT/IB2021/062076

§ 371 (c)(1),
(2) Date: Jun. 23, 2023

(87) PCT Pub. No.: WO2022/137104

PCT Pub. Date: Jun. 30, 2022

(65) Prior Publication Data

US 2024/0271863 A1 Aug. 15, 2024

(30) Foreign Application Priority Data

Dec. 24, 2020 (IT) ..... 102020000032435

(51) Int. Cl.
*F25D 19/04* (2006.01)
*F25D 31/00* (2006.01)

(52) U.S. Cl.
CPC ..... *F25D 31/007* (2013.01); *F25D 19/04* (2013.01); *F25D 2331/803* (2013.01); *F25D 2400/361* (2013.01); *F25D 2700/12* (2013.01)

(58) Field of Classification Search
CPC ..... F25D 19/04; F25D 2331/803; F25D 2400/361; F25D 2500/02; F25D 2700/12;
(Continued)

(56) References Cited

U.S. PATENT DOCUMENTS 6,351,964 B1 * 3/2002 Brancheau ..... A47F 7/28 211/74
8,061,148 B2 11/2011 Ethier et al.
(Continued)

FOREIGN PATENT DOCUMENTS

JP 2001330357 A 11/2001
JP 2004162984 A 6/2004

OTHER PUBLICATIONS

International Search Report and Written Opinion, mailed Jun. 17, 2022, from PCT/IB2021/062076.

*Primary Examiner* — Filip Zec
(74) *Attorney, Agent, or Firm* — Workman Nydegger

(57) ABSTRACT

A refrigerating container for bottles includes a hollow body and refrigerating means. The hollow body includes an inner wall delimiting an inner cavity, an outer wall extending around the inner wall, and a dividing wall which is arranged in the region of a rear end of the hollow body and divides the inner cavity into front and rear portions. The outer wall of the hollow body includes a bottom base side, first lateral sides extending upwards from respective ends of the bottom base side, horizontal sides extending parallel to the bottom base side from respective upper ends of the first lateral sides, second lateral sides extending upwards from inner ends of respective horizontal sides, and an upper base side joining the upper ends of the second lateral sides and extending parallel to the bottom base side.

15 Claims, 5 Drawing Sheets

(58) Field of Classification Search
CPC ... F25D 31/007; F25B 21/02; F25B 2321/023
See application file for complete search history.

(56) References Cited

U.S. PATENT DOCUMENTS

| | | | | |
|---|---|---|---|---|
| 8,887,512 | B2 * | 11/2014 | Olsen | F25D 16/00 62/457.2 |
| 10,464,731 | B2 * | 11/2019 | Grogan | F25B 21/04 |
| 10,674,870 | B1 * | 6/2020 | Joseph | F25B 1/00 |
| 12,050,033 | B2 * | 7/2024 | Kim | F25D 31/007 |
| 2005/0116589 | A1 * | 6/2005 | Conroy | A47B 73/00 312/242 |
| 2009/0038317 | A1 * | 2/2009 | Otey | F25B 21/04 62/3.2 |
| 2010/0018223 | A1 * | 1/2010 | Sundhar | F25D 31/007 62/344 |
| 2019/0368809 | A1 | 12/2019 | Jafa et al. | |

* cited by examiner

REFRIGERATING CONTAINER

TECHNICAL FIELD OF THE INVENTION

The present invention relates to a refrigerating container suitable for holding and refrigerating a bottle, in particular a bottle containing an alcoholic drink.

STATE OF THE ART

In the state of the art, refrigerating containers for different types of bottles containing alcoholic drinks, such as wine, are known. In restaurants, trade fairs or at home, wine racks with four, six or more bottles, ice boxes or wall-mounted bottle racks are mainly used.

Disadvantageously, wine racks, ice containers or wall-mounted bottle racks keep all the bottles they contain at the same temperature, therefore special or different bottles that would require different storage temperatures cannot be stored therein.

Disadvantageously, the refrigerating containers according to the state of the art are large, heavy, and difficult to handle.

For example, a refrigerating container for bottles is known from JP 2004 162984. This known container includes a hollow body defining an internal cavity suitable for holding a bottle to be refrigerated. The hollow body further accommodates refrigerating means, comprising a Peltier cell, a heat sink plate having a finned surface, and a fan that draws air through a grille and blows it onto the heat sink plate. The hollow body is configured in such a way that in the working position of the container the internal cavity extends vertically, and therefore the bottle contained in the container is standing upright, that is, with its axis directed vertically. This solution does not therefore make it possible to stack several containers on top of one another in order to create a refrigerating apparatus comprising several containers that can be used independently of each other.

Any stacking of the containers on top of each other, which is neither envisaged nor suggested in this prior art document, would prevent bottles from being inserted into, or withdrawn from, the underlying containers, as the respective opening lids would be blocked in the closed position by the containers above. Moreover, a possible use of the container in a horizontal position, therefore with the bottle contained therein lying down, instead of standing up, is neither envisaged nor suggested in this prior art document and, moreover, due to the shape of the hollow body, it would only be possible by arranging the containers one on top of the other, with the consequence that the resulting refrigerating apparatus would only develop in a vertical direction and would be not very stable.

SUMMARY OF THE INVENTION

It is an object of the present invention to provide a refrigerating container for bottles, which is suitable for being mounted together with other refrigerating containers to form a refrigerating apparatus in which the bottles contained in the containers are arranged lying down, i.e. with their axis oriented horizontally, and can be inserted into, or withdrawn from, the respective container independently of each other, and in which, moreover, the refrigerating apparatus thus formed has a particularly stable configuration, which develops both in a vertical direction and in a horizontal direction.

A further object of the present invention is to provide a refrigerating container for bottles, which allows each bottle to be stored in such a way as to best enhance its contents, which allows different storage temperatures to be chosen for each bottle, which allows the set temperature to be maintained for a long time without power supply, and which is lightweight, small in size and easy to handle.

These and other objects are achieved, according to the present invention, by a refrigerating container as defined in independent claim 1.

The present invention also relates to a refrigerating apparatus as defined in claim 14. Other advantageous features of the refrigerating container and the refrigerating apparatus according to the present invention are set forth in the dependent claims, the subject-matter of which is intended to form an integral part of the following description.

BRIEF DESCRIPTION OF THE DRAWINGS

Further features and advantages of the present invention will be more apparent from the following description, which is given purely by way of non-limiting example with reference to the accompanying schematic drawings, in which.

DETAILED DESCRIPTION

Figure 1:
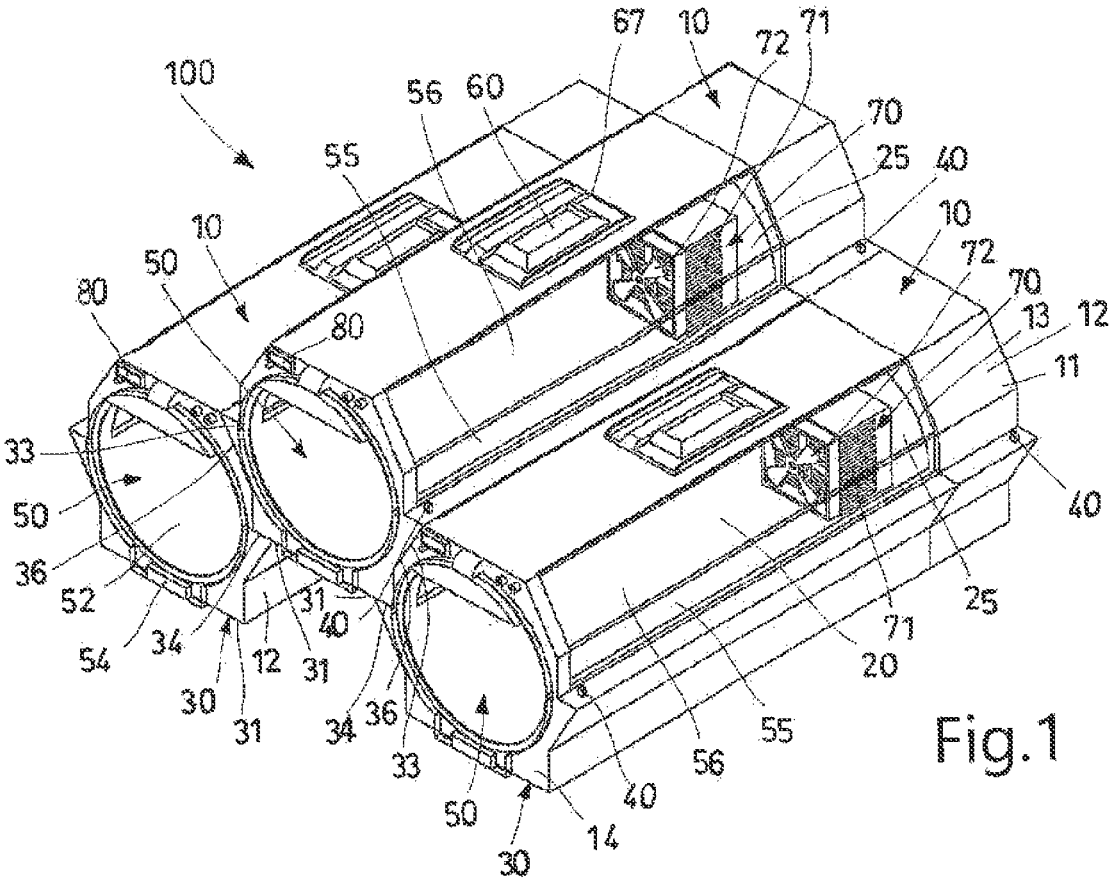
FIG. 1 is a perspective view from above and in front of a refrigerating apparatus comprising three refrigerating containers according to an embodiment of the present invention.
Figure 2:
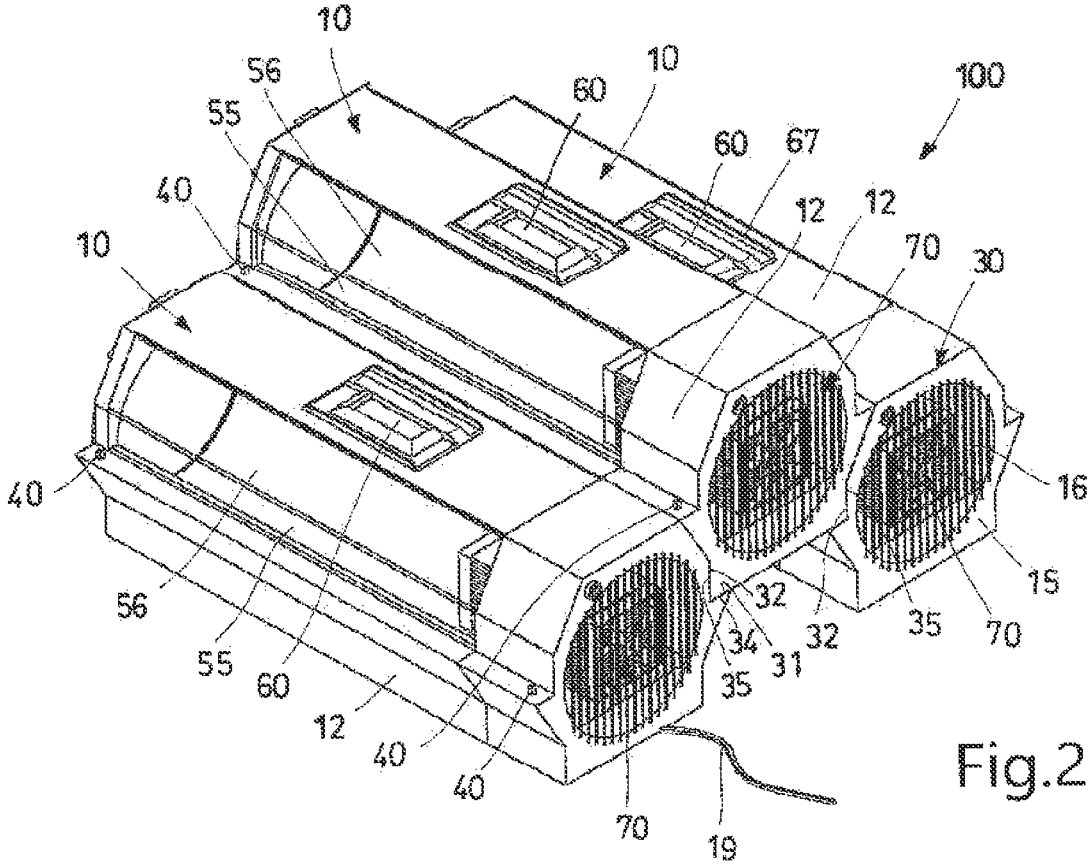
FIG. 2 is a perspective view from above and from behind of the refrigerating apparatus of FIG. 1.

With reference first to FIGS. 1 and 2, a refrigerating apparatus comprising a plurality of refrigerating containers 10 identical to each other, preferably three or more refrigerating containers, is generally referred to as 100. In the example shown in FIGS. 1 and 2, the refrigerating apparatus 100 comprises three refrigerating containers.

The refrigerating containers 10 are detachably connectable to each other, such that the refrigerating apparatus 100 can switch from a mounted configuration in which the refrigerating containers 10 are mounted on each other, as shown in FIGS. 1 and 2, to a disassembled configuration in which the refrigerating containers 10 do not rest on each other.

As shown in particular in FIGS. 3 to 6, each refrigerating container 10 comprises a hollow body 11 having an outer wall 12 and an inner wall 13, wherein the latter delimits an inner cavity 20 suitable for receiving within it at least one bottle (not shown), for example a wine bottle.

The inner cavity 20 has the shape of a hollow cylinder with a circular cross-section extending along a longitudinal geometric axis. As shown in FIGS. 1 to 6, in the operating condition, in which the hollow body 11 rests with one of the faces of the outer wall 12 on a supporting surface (not shown), the longitudinal geometric axis of the inner cavity 20 of each refrigerating container 10 is directed parallel to the supporting surface, in that it lies in a plane parallel to the supporting surface (in the example shown herein, a horizontal plane).

The outer wall 12 of the refrigerating container 10 defines a polygonal cross-section 30.

Figure 5:
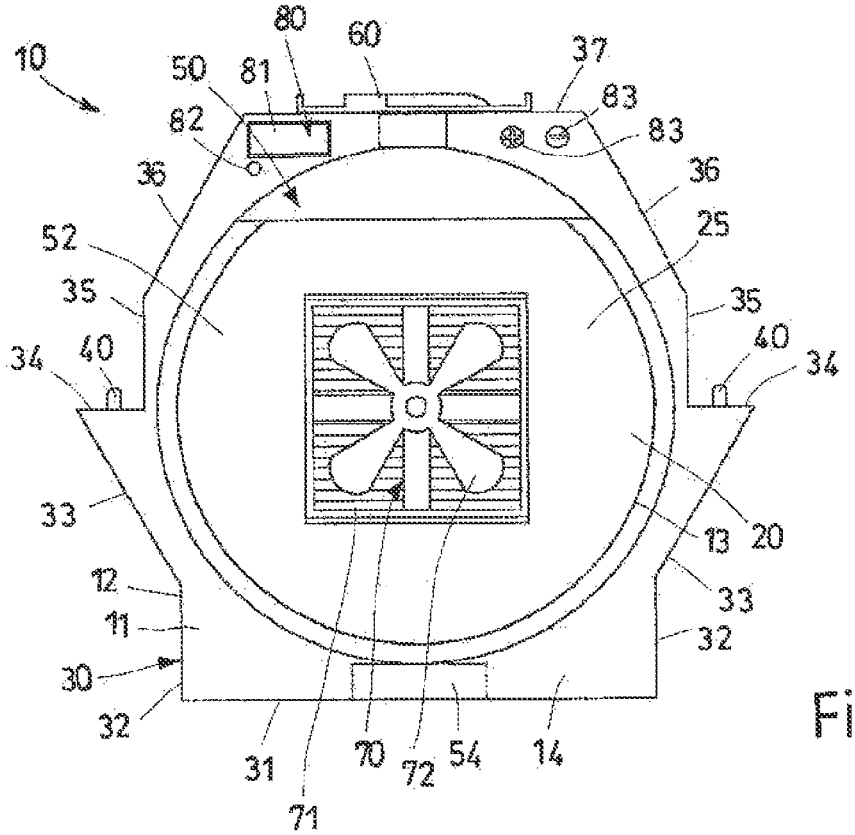
FIG. 5 is a front view of the refrigerating container of FIG. 3.
Figure 6:
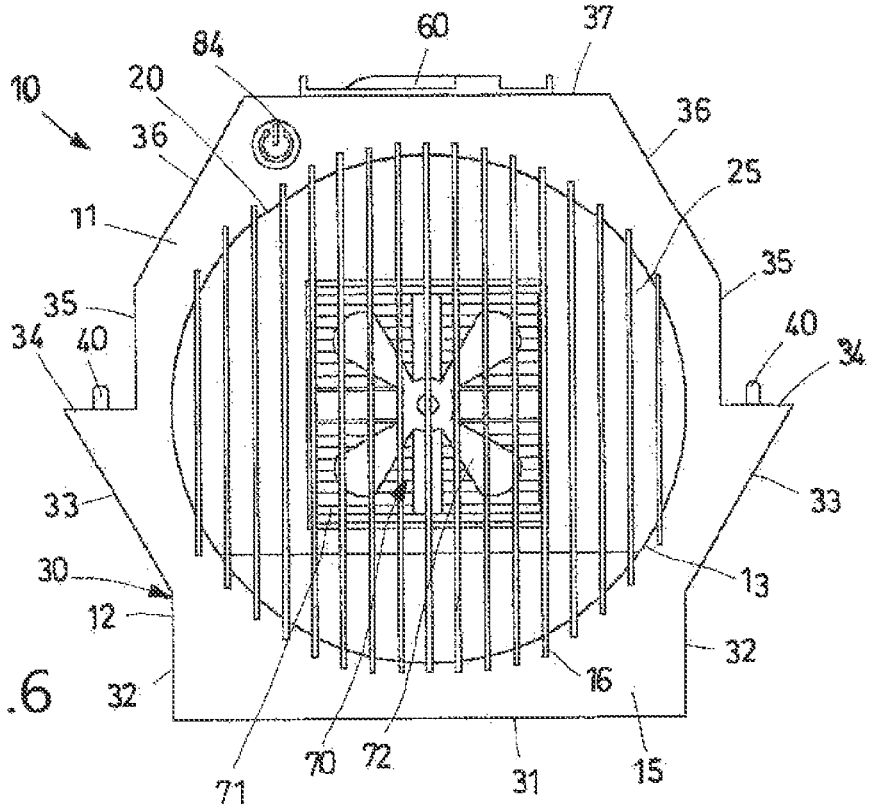
FIG. 6 is a rear view of the refrigerating container 5 of FIG. 3.

Referring in particular to FIGS. 5 and 6, the polygonal cross-section 30 comprises first of all a lower base side 31, which in the above-mentioned operating condition is arranged parallel to the supporting surface, in particular horizontally, so that the refrigerating container 10 can be supported in a stable manner on that surface.

The polygonal cross-section 30 further comprises two first lateral sides which rise upwards from the two opposite ends of the lower base side 31.

According to the embodiment of FIGS. 5 and 6, each of said first lateral sides comprises a vertical side section 32, extending vertically (or, more generally, perpendicular to the lower base side 31) from a respective end of the lower base side 31, and an oblique side section 33, extending in an oblique direction inclining outwardly from the refrigerating container 10 and extending upwardly from the upper end of the vertical side section 32 of the respective first lateral side, so as to increase a transverse width of the polygonal cross-section 30.

The polygonal cross-section 30 further comprises two sides 34 which, starting from the respective upper ends of the oblique side sections 33 of the first two lateral sides, decrease the transverse width of the polygonal cross-section 30. The sides 34 will be hereinafter referred to as horizontal sides, since in the position shown in the drawings they extend horizontally. More generally, the sides 34 extend parallel to the lower base side 31.

Advantageously, the two horizontal sides 34 are suitable for allowing a portion of the outer wall 12 of another refrigerating container 10 comprising the base side 31 to be supported when the refrigerating apparatus 100 is in the mounted configuration as shown in FIGS. 1 and 2.

The polygonal cross-section 30 further comprises two second lateral sides which extend upwards each starting from the inner end of a respective horizontal side 34. According to the embodiment of FIGS. 5 and 6, each of said second lateral sides comprises a vertical side section 35, which extends vertically (or, more generally, perpendicular to the lower base side 31) from the inner end of the respective horizontal side 34.

Advantageously, the vertical side sections 32 of the first lateral sides have the same length as the vertical side sections 35 of the second lateral sides, such that the vertical side sections 32 of a first refrigerating container 10 match the vertical side sections 35 of a second refrigerating container 10 when the refrigerating apparatus 100 is in the mounted configuration as shown in FIGS. 1 and 2. Each of the second lateral sides of the polygonal cross-section 30 further comprises an oblique side section 36 extending in an oblique direction inclining inwardly from the refrigerating container 10 and upwardly from the upper end of the vertical side section 35 of the respective second lateral side, so as to reduce the transverse width of the polygonal cross-section 30.

Advantageously, the oblique side sections 33 of the first lateral sides and the oblique side sections 36 of the second lateral sides have the same length, so that when the refrigerating apparatus 100 is in the mounted configuration the oblique side section 33 of a refrigerating container 10 matches the oblique side section 36 of another refrigerating container 10.

Finally, the polygonal cross-section 30 comprises an upper base side 37 joining the two upper ends of the oblique side sections 36 of the two second lateral sides. The upper base side 37 extends parallel to the lower base side 31.

Advantageously, the fact that the shape of the polygonal cross-section 30 is such that in the mounted configuration of the refrigerating apparatus 100 the vertical side section 32 and the oblique side section 33 of one of the first lateral sides of a refrigerating container 10 match in shape with the vertical side section 35 and the oblique side section 36 of one of the second lateral sides of another refrigerating container 10 allows a solid and secure assembly of several refrigerating containers 10 to form the refrigerating apparatus 100.

Figure 3:
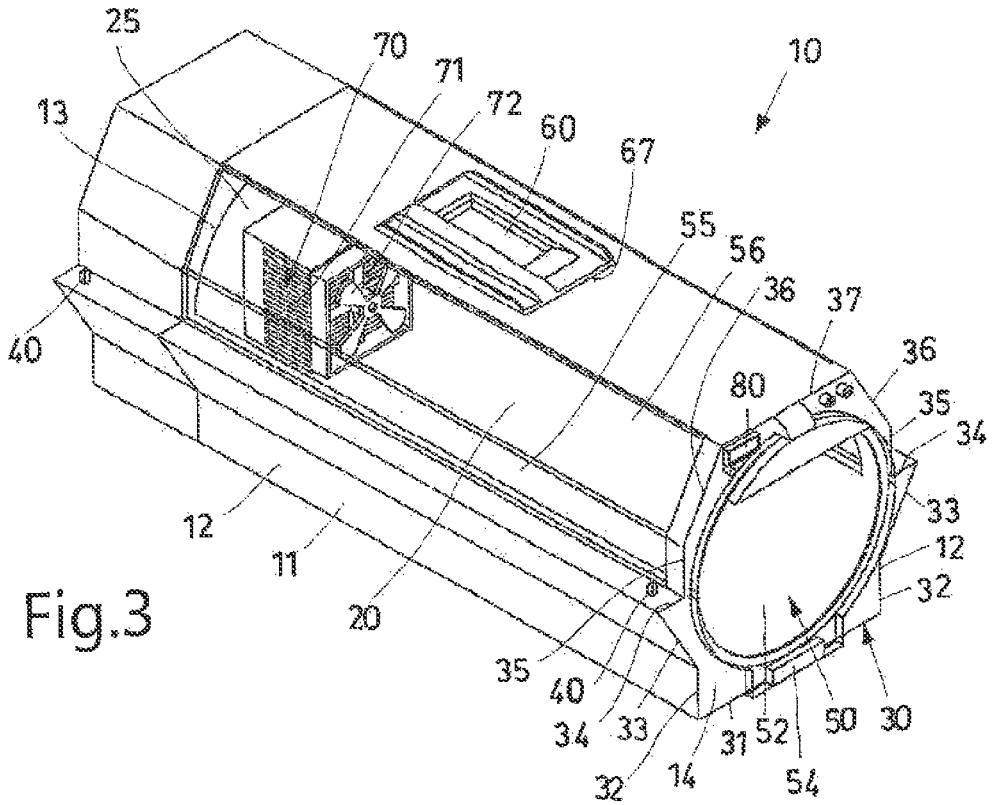
FIG. 3 is a perspective view from above and in front of one of the three refrigerating containers of the refrigerating apparatus of FIG. 1.
Figure 4:
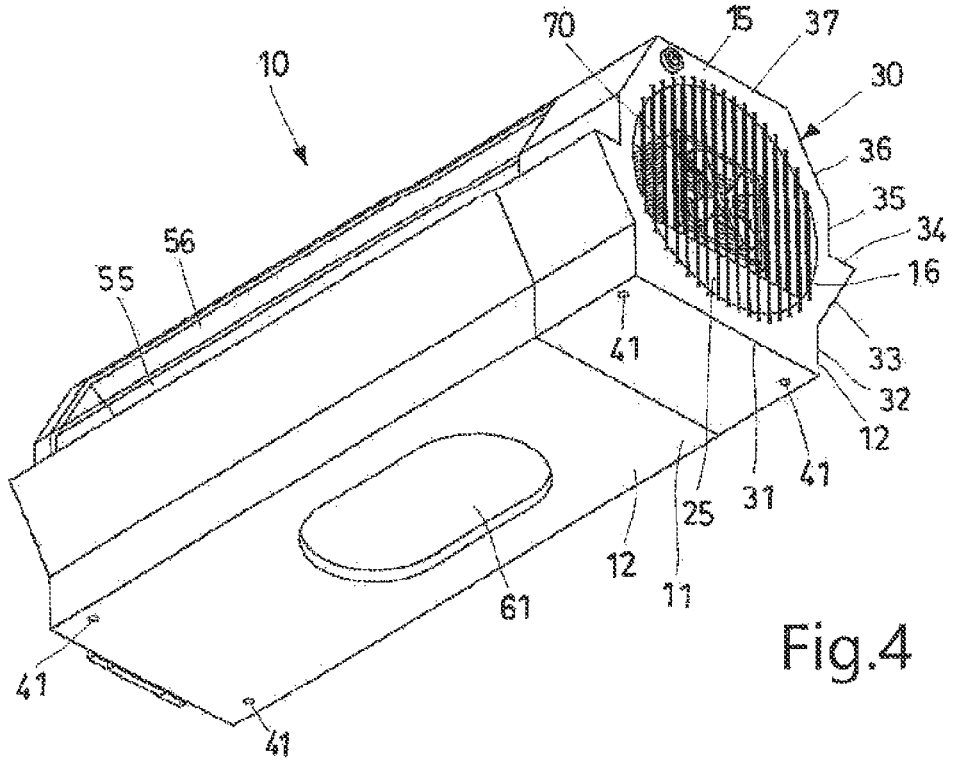
FIG. 4 is a perspective view from below and from behind of the refrigerating container of FIG. 3.

Preferably, the refrigerating container 10 comprises first interlocking means 40, which extend upwards from each of the two horizontal sides 34, as shown in FIGS. 1-3 and 5-6, and second interlocking means 41, which are provided in the lower base side 31 and are complementary to the first interlocking means 40, as shown in FIG. 4. The second interlocking means 41 of a refrigerating container 10 are suitable for interlocking with respective first interlocking means 40 of another refrigerating container 10 when the refrigerating apparatus 100 is in the mounted configuration (FIGS. 1 and 2).

In particular, as in the example of FIGS. 1-6, the first interlocking means 40 are formed by two pins for each of the two horizontal sides 34, for a total of four pins, while the second interlocking means 41 provided in the lower base side 31 are formed by four holes of a shape and size suitable to accommodate the four pins 40 so that the refrigerating apparatus 100 in the mounted configuration is held fixed even more securely.

More generally, the first interlocking means 40 are formed by male elements extending upwards, preferably in a vertical direction (i.e., perpendicular to the plane of the horizontal sides 34), while the second interlocking means 41 are formed by female elements suitable to receive each a respective one of the male elements.

Preferably, as shown in particular in FIGS. 1-4, the outer wall 12 comprises, in the region of the vertical side section 35 of each second lateral side, a transparent or semi-transparent portion 55 suitable for allowing to see the inner cavity 20, and therefore what is contained therein.

Even more preferably, as shown in particular in FIGS. 1-4, the outer wall 12 comprises, in the region of the oblique side section 36 of each second lateral side, a transparent or semi-transparent portion 56 suitable for allowing to see the inner cavity 20, and therefore what is contained therein.

The transparent or semi-transparent portions 55, 56 allow to see inside the refrigerating containers 10 when these latter are stacked to form the refrigerating apparatus 100 in the mounted configuration, as shown in FIGS. 1 and 2.

The polygonal cross-section 30 of the outer wall 12 of the hollow body 11 described above allows to easily manufacture the refrigerating container 10, to easily stack several refrigerating containers 10 to form the refrigerating apparatus 100, as well as to easily disassemble the refrigerating apparatus 100.

The mounted configuration of the refrigerating apparatus 100 provides that at least three refrigerating containers 10 are mounted together such that a first lateral side, including both the vertical side section 32 and the oblique side section 33, of a first refrigerating container 10 matches a second lateral side, including both the vertical side section 35 and the oblique side section 36 of a second refrigerating container 10 and that an end portion of the lower base side 31 of the second refrigerating container 10 rests on a horizontal side 34 of the first refrigerating container 10.

Further, even more advantageously, the aforementioned end portion of the lower base side 31 of the second refrigerating container 10 is interlocked with the respective horizontal side 34 of the first refrigerating container 10 by engagement between the first interlocking means 40 of the first refrigerating container 10 and the second interlocking means 41 of the second refrigerating container 10.

Even more preferably, the outer wall 12 of the hollow body 11 of the refrigerating container 10 is provided, in the region of the upper base side 37, with a handle 60 in order to make the assembly and disassembly operations of the refrigerating apparatus 100 easier and to allow to handle the single refrigerating container 10 in a simpler and more effective way, thereby making the transport easier and safer.

As shown in particular in FIGS. 1-3, preferably the handle 60 is recessed at least in part into an upper housing 67 provided in the portion of the outer wall 12 comprising the upper base side 37, while for the remaining part it protrudes upwards.

As shown in particular in FIG. 4, a lower seat 61 is provided on the opposite side of the outer wall 12, i.e., in the lower base side 31, aligned with the handle 60. The lower seat 61 is as deep as the part of the handle 60 projecting upwards from the upper base side 37, so that when two refrigerating containers 10 are placed on top of each other in a compact transport configuration, the lower base side 31 of the upper container can rest on the upper base side 37 of the lower container.

As shown in FIGS. 1, 3 and 5, an opening door 50 is provided on a front wall 14 of the hollow body 11 of each refrigerating container 10 for closing the inner cavity 20 from the front.

The opening door 50 is movable between a closed position in which it prevents access to the inner cavity 20 and an open position in which it allows access to the inner cavity 20 to allow a bottle to be inserted into said cavity or removed from said cavity. For example, the opening door 50 is mounted on the front wall 14 by means of a hinge 54.

Preferably, the opening door 50 comprises a transparent portion 52 to enable the bottle disposed within the inner cavity 20 of the refrigerating container 10 to be seen.

Preferably, the opening door 50 is thermally insulated.

Preferably, the hollow body 11 of the refrigerating container 10 is made almost entirely of wood or other thermally insulating material. In particular, at least the outer wall 12 of the hollow body 11 is made of wood or other thermally insulating material.

The transparent or semi-transparent portions 55 and 56 of the outer wall 12 are made of glass, Plexiglas or other plastic material so as not only to allow to see inside the inner cavity 20 but also to be thermally insulating.

The inner wall 13 of the hollow body 11 is made at least in part of wood or other thermally insulating material. In particular, the portions of the inner wall 13 corresponding to the transparent or semi-transparent portions 55 and 56 of the outer wall 12 are made of glass, Plexiglas or other transparent or semi-transparent plastic material.

There is also provided a transparent tube, not shown in the drawings, again made of Plexiglas, glass or other transparent or semi-transparent plastic material, advantageously suitable for providing support for the neck of the bottle.

The refrigerating container 10 further comprises a dividing wall 25 arranged near the rear end of the refrigerating container 10 so as to divide the internal cavity 20 into two portions, namely a front portion for housing the bottle and a rear portion.

Preferably, the dividing wall 25 is a polyurethane layer that acts as a thermal insulator between the front portion and the rear portion of the inner cavity 20.

Preferably, the dividing wall 25 has a thickness of between 2 and 3 centimetres.

The dividing wall 25 may also act as a support for the transparent tube for holding the neck of the bottle.

Each refrigerating container 10 is provided with refrigerating means 70 arranged to refrigerate the inner cavity 20, preferably by maintaining the inner cavity 20 at a temperature that can be set on a desired value.

The desired temperatures may be different for each refrigerating container 10 forming the refrigerating apparatus 100.

The refrigerating means 70 are mounted with the dividing wall 25, as shown in FIGS. 1-6, such that a portion of the refrigerating means 70 is housed within the front portion of the inner cavity 20, while the remaining portion of the refrigerating means 70 is housed within the rear portion of the inner cavity 20.

A rear wall 15 of the hollow body 11 of the refrigerating container 10 has a grille 16 mounted thereon, which protects the rear portion of the inner cavity 20 while allowing a flow of air from the refrigerating means 70 to flow out of the refrigerating container 10.

Preferably, the grille 16 is made of plastic material, but may also be made of another material, for example formed by a metal wire mesh.

The refrigerating means 70 comprise a solid-state module having a high cooling performance. The module is a thermoelectric cell comprising a plurality of solid-state junctions in series exploiting the Peltier effect. The thermoelectric cell may be of various sizes and wattages. The thermoelectric cell comprises a thin plate with two ends to which a DC voltage is applied. The thermoelectric cell has a cold face from which it absorbs heat and a hot face to which it transfers the absorbed heat. The direction in which the heat is transferred is reversible depending on the difference in voltage applied to the ends of the plate.

The use of a thermoelectric cell is particularly advantageous since the thermoelectric cell can be extremely compact in size, can be powered simply by direct current, is silent, given the absence of pumps to move the cooling fluid, and has an excellent efficiency in terms of temperature difference between the hot face and the cold face. In addition, the thermoelectric cell has a simple structure and can be easily assembled and replaced if necessary.

Two heat sinks 71, in particular made of aluminium, are coupled to the thermoelectric cell plate, which are in direct contact with the hot face and the cold face of the thermoelectric cell plate, respectively, for example by means of thermal paste with a high conductive heat transfer coefficient. The heat sinks 71 are preferably mounted on the dividing wall 25, on opposite sides thereof, therefore one in the front portion and the other in the rear portion of the internal cavity 20, as shown in FIGS. 1-6.

Furthermore, preferably, in order to facilitate convective heat exchange, two fans 72 are placed at the ends of two finned surfaces of the two heat sinks 71.

The refrigerating means 70 further comprise a thermostat, which is disposed within the front portion of the inner cavity 20 housing the bottle. The thermostat, depending on the temperature set by the user and the temperature detected in the inner cavity 20, activates or deactivates the thermoelectric cell and the fans 72. Instead of one thermostat only, several thermostats and/or temperature sensors may be provided.

For the power supply of the refrigerating container 10, and in particular for the power supply of the refrigerating means 70, an external DC voltage generator is used which is able to continuously supply the thermoelectric cell, the fans and the thermostat.

Each refrigerating container 10 is provided with a scalable power supply system, which can be connected to the mains via a cable 19, as shown in FIG. 2, and operate autonomously.

As shown in FIG. 2, when the refrigerating containers 10 are mounted to form the refrigerating apparatus 100, the refrigerating containers 10 share the power supply from the cable 19, so it is sufficient that only one of the refrigerating containers 10 is connected to the mains.

When several refrigerating containers 10 are assembled together to form the refrigerating apparatus 100, each refrigerating container 10 is autonomous in terms of temperature control, so each refrigerating container 10 has the possibility of maintaining in the front portion of its inner cavity 20, where the bottle to be kept cool is inserted, a temperature different from the other refrigerating containers 10 of the refrigerating apparatus 100.

The desired temperature can be set by the user by means of a control interface 80 and/or a remote control, for example an application for a smartphone or other electronic device.

As shown in particular in FIG. 5, in the case where a control interface 80 is provided, preferably this latter comprises first of all a screen 81, for example an LCD display, showing the current temperature in the front portion of the inner cavity 20 housing the bottle. The control interface 80 may also comprise a button 82 for activating the illumination of the screen 81. In the event that the screen 81 is always active, the button 82 will not be provided.

The control interface 80 further comprises at least one button 83 or other adjustment member to allow the user to increase or decrease the temperature in the front portion of the inner cavity 20. Two buttons 83 are shown in FIG. 5, the first button for increasing the temperature and the second one for decreasing the temperature, but only one button operable in one direction for increasing the temperature and in the other direction for decreasing the temperature might be provided.

Preferably, a power button 84 is mounted on the rear wall 15 of the refrigerating container 10 to allow the user to turn the refrigerating container 10 on or off.

Preferably, the control interface 80 further comprises a control board for controlling the refrigerating container 10 and/or a wireless connection module.

Preferably, the refrigerating container 10 has sizes of 17×20×48 centimetres and a weight of about 1.5 kg, excluding the weight of the refrigerating means 70.

Figure 7:
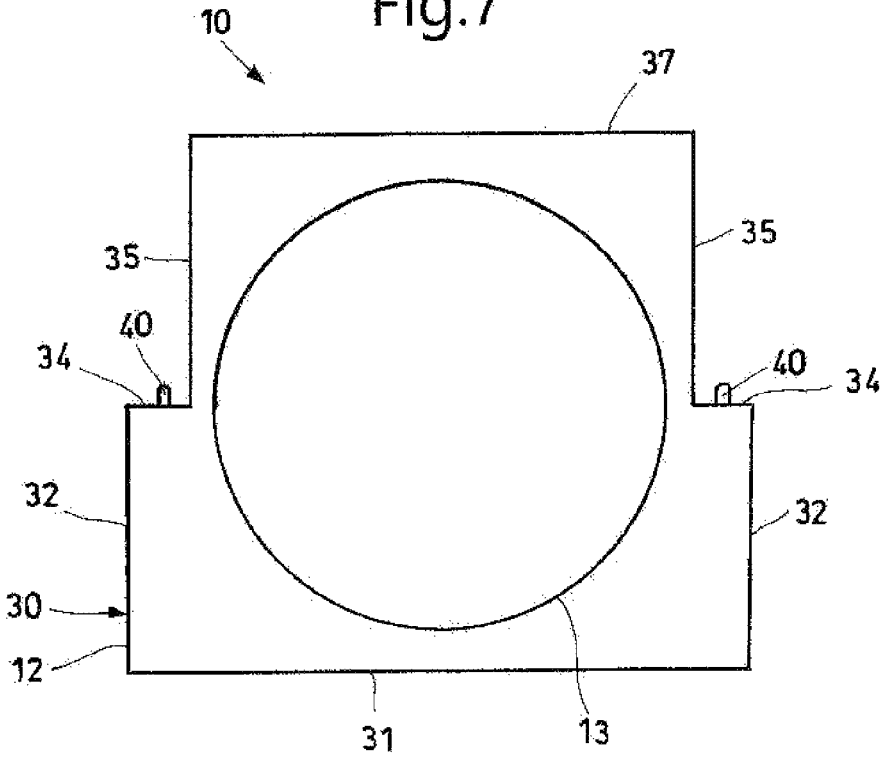
FIGS. 7 to 9 show polygonal cross-sections of the refrigerating container which are alternative to that of the refrigerating container of FIG. 3.
Figure 8:
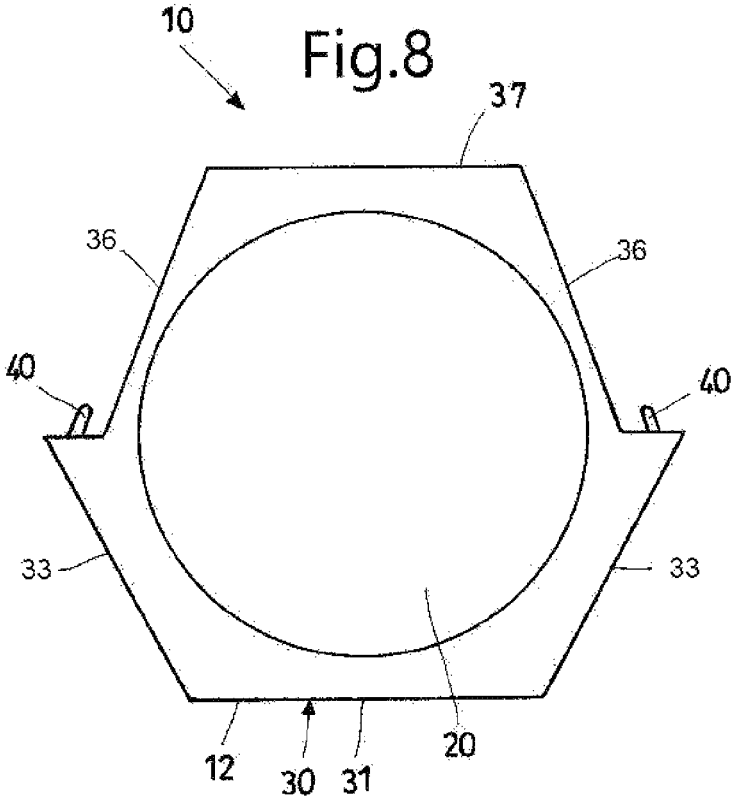
Figure 9:
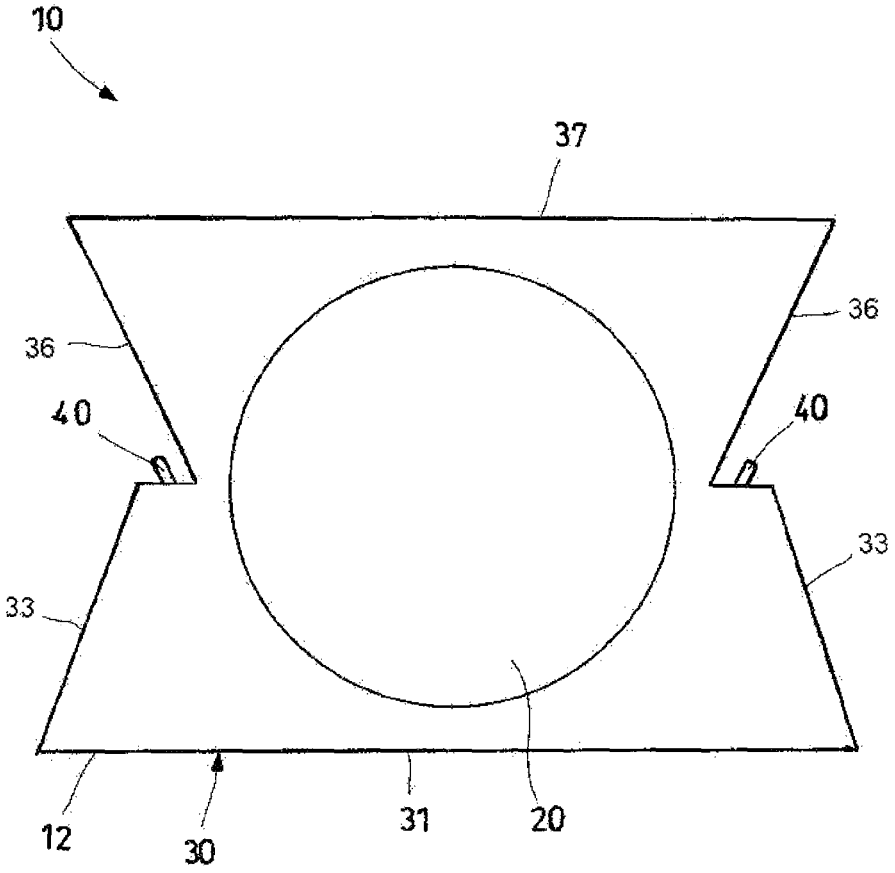

Finally, with reference to FIGS. 7-9, in which parts and elements of the refrigerating container identical or corresponding to those of the refrigerating container of FIGS. 1-6 have been assigned the same reference numbers, the outer wall 13 of the hollow body 11 may have a polygonal cross-section 30 with a shape different from that of FIGS. 1-6.

In the example of FIG. 7, the two first lateral sides are each formed only by the vertical side section 32 (which therefore extends from a respective end of the lower base side 31 to the outer end of the respective horizontal side 34) and, likewise, the two second lateral sides are each formed only by the vertical side section 35 (which therefore extends from the inner end of the respective horizontal side 34 to a respective end of the upper base side 37). Thus, with respect to the embodiment of FIGS. 1-6, the oblique side sections 33 and 36 of the first lateral sides and of the second lateral sides, respectively, are missing.

Alternatively, as shown in FIGS. 8 and 9, the two first lateral sides may each comprise only the oblique side section 33 and, likewise, the two second lateral sides may each comprise only the oblique side section 36. In particular, in the example of FIG. 8 the two first lateral sides extend upwards from the lower base side 31 increasing the lateral width of the polygonal cross-section 30, while the second lateral sides extend upwards from the horizontal sides 34 reducing the lateral width of the polygonal cross-section 30.

On the contrary, in the example of FIG. 9 the two first lateral sides extend upwards from the lower base side 31 reducing the lateral width of the polygonal cross-section 30, while the second lateral sides extend upwards from the horizontal sides 34 increasing the lateral width of the polygonal cross-section 30. In both these alternatives the first interlocking means 40 protrude upwards from the horizontal sides 34 with the same inclination as the second lateral sides, so as to facilitate the engagement of a first refrigerating container 10 on top of a second refrigerating container 10.

The advantages of a refrigerating container according to the invention are apparent from the above description.

The refrigerating container enables the bottle contained therein to reach the right temperature in a short time.

Due to the fact that it comprises at least one portion of transparent or semi-transparent wall, the refrigerating container allows to see the bottle contained therein.

The refrigerating container is lightweight, small, and easy to handle.

Thanks to the conformation of its outer wall, the refrigerating container can be easily and stably connected to other identical refrigerating containers to form a refrigerating apparatus, in which each refrigerating container is independent of the others and can therefore maintain the bottle contained therein at a different temperature from that of the other refrigerating containers.

The invention thus conceived is susceptible to many modifications and variations, all of which fall within the scope of protection defined by the appended claims.

For example, the first interlocking means projecting from the horizontal sides 34 of the polygonal cross-section 30 may each be formed by a pin extending along the longitudinal dimension of the refrigerating container 10, i.e. parallel to the horizontal side 34, while the second complementary interlocking means may each be formed by a longitudinal slot provided in the outer wall 12 at the lower base side 31.

Alternatively, the first interlocking means may be formed by female elements and the second interlocking means by male elements.

Alternatively, the first and second interlocking means may be magnets of opposite polarity. The rear wall 15 of the refrigerating container 10 may be provided with protruding elements, preferably made of wood, suitable for acting as support feet to allow the refrigerating container 10 to be positioned vertically with the rear wall 15 facing the supporting surface, while still ensuring air circulation through the grille 16. The inner wall 13 of the hollow body 11 may be formed by a hollow cylindrical container of glass, Plexiglas or other plastic material, with two through openings at the longitudinally opposite ends.

The invention claimed is:

1. A refrigerating container for refrigerating at least one bottle, comprising:

a hollow body and refrigerating means, wherein the hollow body includes an inner wall delimiting an inner cavity, an outer wall extending around the inner wall, and a dividing wall which is arranged in a region of a rear end of the hollow body and divides the inner cavity into a front portion that is configured to accommodate the at least one bottle, and a rear portion that is configured to at least partly accommodate the refrigerating means, wherein at least the inner wall and the dividing wall of the hollow body are made of thermally insulating material, wherein the outer wall of the hollow body has a polygonal cross-section, and wherein the polygonal cross-section comprises:

a bottom base side, a pair of first lateral sides extending upwards from respective ends of the bottom base side, a pair of horizontal sides, extending parallel to the bottom base side from respective upper ends of the first lateral sides decreasing the width of the polygonal cross-section, a pair of second lateral sides extending upwards from inner ends of the respective horizontal sides, and an upper base side joining the upper ends of the second lateral sides and extending parallel to the bottom base side.

2. The refrigerating container according to claim 1, wherein each of the first lateral sides comprises a first side section extending perpendicular to the bottom base side and/or a second side section extending in a direction oblique to the bottom base side, and wherein each of the second lateral sides comprises a first side section extending perpendicular to the bottom base side and a second side section extending in an oblique direction with respect to the bottom base side.

3. The refrigerating container according to claim 2, wherein each of the first lateral sides comprises both the first side section and the second side section, the second side section being inclined towards the outside of the refrigerating container so as to increase a width of the polygonal cross-section, and wherein each of the second lateral sides comprises both the first side section and the second side section, the second side section being inclined towards the inside of the refrigerating container so as to reduce the width of the polygonal cross-section.

4. The refrigerating container according to claim 3, wherein the first side sections of the first lateral sides and the first side sections of the second lateral sides have the same length, and wherein the second side sections of the first lateral sides and the second side sections of the second lateral sides have the same length.

5. The refrigerating container according to claim 1, further comprising first interlocking means provided on each horizontal side and second interlocking means provided on the bottom base side and suitable for engaging with the first interlocking means of another refrigerating container.

6. The refrigerating container according to claim 5, wherein said first interlocking means are formed by male elements and wherein said second interlocking means are formed by female elements, each of which is suitable for receiving a respective male element.

7. The refrigerating container according to claim 1, wherein the outer wall of the hollow body comprises, at each second lateral side of the polygonal cross-section, at least one transparent or semi-transparent portion for allowing the inner cavity to be seen from the outside.

8. The refrigerating container according to claim 1, wherein the outer wall of the hollow body is provided, on the upper base side of the polygonal cross-section, with a handle at least partially protruding from said side, and has, on the bottom base side of the polygonal cross-section, aligned with the handle, a lower seat suitable for receiving a portion of said handle projecting from said upper base side.

9. The refrigerating container according to claim 1, wherein said refrigerating means comprise a thermoelectric cell with a plurality of solid-state junctions in series exploiting the Peltier effect, wherein said thermoelectric cell comprises a plate having a hot side and a cold side.

10. The refrigerating container according to claim 9, wherein said refrigerating means further comprise a first heat sink in contact with the hot side of said plate and a second heat sink in contact with the cold side of said plate, said first and second heat sinks being mounted on the dividing wall.

11. The refrigerating container according to claim 10, wherein the refrigerating means comprise a pair of fans which are each mounted on a respective heat sink, and wherein one fan is housed in the front portion of the inner cavity, while the other fan is housed in the rear portion of the inner cavity.

12. The refrigerating container according to claim 1, wherein the refrigerating means comprises at least one thermostat disposed in the front portion of the inner cavity.

13. The refrigerating container according to claim 1, comprising a control interface with at least one screen and at least one control button for adjusting a temperature in the front portion of the inner cavity.

14. A refrigerating apparatus comprising a plurality of refrigerating containers according to claim 1.

15. The refrigerating apparatus according to claim 14, further comprising at least a first, a second and a third refrigerating container assembled with each other so that the first refrigerating container rests with its bottom base side on a horizontal side of the second refrigerating container and on a horizontal side of the third refrigerating container, so that one first lateral side of the first refrigerating container matches a second lateral side of the second refrigerating container, and so that the other first lateral side of the first refrigerating container matches a second lateral side of the third refrigerating container.

* * * * *